United States Patent [19]

Fischer

[11] Patent Number: 5,026,480

[45] Date of Patent: Jun. 25, 1991

[54] DECANTING APPARATUS

[76] Inventor: Rudolf Fischer, Habsburgstrasse 13, Rudolfstetten-Friedlisberg, CH-8968 Mutschellen, Switzerland

[21] Appl. No.: 525,149

[22] Filed: May 17, 1990

[30] Foreign Application Priority Data

May 17, 1989 [CH] Switzerland ..... 1842/89

[51] Int. Cl.[5] ..... B01D 21/00

[52] U.S. Cl. ..... 210/515; 222/166; 414/421

[58] Field of Search ..... 222/166; 414/421; 210/514, 513, 515, 518, 532.1, 533–538, 539, 540

[56] References Cited

U.S. PATENT DOCUMENTS 3,868,047 2/1975 Bersano ..... 222/166

*Primary Examiner*—Frank Sever

*Attorney, Agent, or Firm*—Peter K. Kontler

[57] ABSTRACT

A decanting apparatus wherein a carrier in the form of a cradle or balance beam is tiltable, swingable or rockable in response to flow of red wine or another flowable substance from a first vessel (e.g., a bottle of wine) on one arm of the carrier into a second vessel (e.g., a carafe) on the other arm of the carrier. Each arm of the carrier has one or more braces which support the respective vessel, and the mouth of the first vessel registers with (e.g., extends into) the mouth of the second vessel. The final position of inclination of the carrier is selected in such a way that sediment (if any) remains in the residue of flowable material in the first vessel. The apparatus can be operated by unskilled persons and can complete the decanting operation within a short interval of time.

20 Claims, 3 Drawing Sheets

DECANTING APPARATUS

BACKGROUND OF THE INVENTION

The invention relates to decanting apparatus in general, and more particularly to improvements in apparatus for transferring flowable substances (especially liquids) from first vessels into second vessels. Still more particularly, the invention relates to improvements in apparatus which can be utilized with advantage for decanting of red wines, port wines or other sediment-containing liquids from jugs, bottles or other containers into carafes or into other types of vessels.

When certain red wines are stored in bottles for extended periods of time, at least some sediments or dregs are bound to accumulate at the bottom of the bottle. It is desirable to pour such wines into glasses or into a carafe with retention of accumulated sediments in the bottle. Such decanting of wines into glasses or carafes requires concentration, a certain amount of skill, strong (steady) hands and patience.

In accordance with a presently known proposal, a bottle for red wine, port or another liquid which normally contains sediments is placed onto a rocker which is coupled to a crank by way of a spindle. By rotating the crank, the operator changes the inclination of the rocker and of the bottle to thus ensure gradual outflow of wine from the bottle while the sediment remains at the bottom of the partly or fully emptied bottle. A drawback of this conventional decanting apparatus is that it is bulky and that the glass or carafe which is to receive sediment-free liquid must be held by hand. Moreover, the manipulation of such apparatus necessitates much attention because the hand which holds the glass or carafe must ensure that the mouth of the carafe or the open top of the glass remains in proper position relative to the mouth of the bottle while the inclination of the bottle changes in response to manipulation of the crank. Thus, one hand must be used to manipulate the crank and the other hand must be used to maintain the carafe or the glass in requisite position relative to the bottle. Moreover, the decanting operation is even more time consuming than if the bottle were held by one hand while the carafe or the glass is grasped by the other hand.

OBJECTS OF THE INVENTION

An object of the invention is to provide a novel and improved decanting apparatus which can automatically transfer the flowable contents of one vessel into another vessel.

Another object of the invention is to provide a decanting apparatus whose manipulation requires a minimum of skill and wherein the decanting operation can proceed automatically as soon as the two vessels are properly positioned relative to each other.

A further object of the invention is to provide an apparatus which can complete the decanting operation within a relatively short interval of time without splashing or other stray movements of the flowable substance during transfer from one of the vessels into the other vessel.

An additional object of the invention is to provide a novel and improved carrier of vessels for use in the above outlined apparatus.

Still another object of the invention is to provide a decanting apparatus which can be used with equal advantage in homes as well as in commercial establishments.

A further object of the invention is to provide a simple, compact and inexpensive apparatus which can be designed to constitute a decorative object when not in actual use.

Another object of the invention is to provide a novel and improved method of decanting heavy red wines, port wines and other beverages which are likely to contain sediments and should be decanted without sediment.

SUMMARY OF THE INVENTION

The invention is embodied in an apparatus for preferably gradually decanting a flowable substance from the mouth of a first vessel into the mouth of a second vessel, particularly for decanting wine (such as port or red wine) from a bottle into a carafe while preventing the transfer of sediment (if any) into the second vessel. The apparatus comprises a mobile carrier having a first portion including means for supporting the first vessel and a second portion including means for supporting the second vessel so that the mouth of the second vessel registers with the mouth of the first vessel. The carrier is movable by the flowable substance from a starting position in which the upper level of the flowable substance in the first vessel is sufficiently high to permit gravity-induced flow of flowable substance from the first vessel into the second vessel, through a plurality of intermediate positions, and to a further position in which at least the major part of flowable substance is confined in the second vessel but the sediment (if any) remains in the first vessel.

The carrier is preferably movable about at least one axis and the mouth of the second bottle in the starting position of the carrier is located at least in part beneath the upper level of flowable substance in the first vessel. The ratio of a first moment including the product of gravity force acting upon the supporting means of the first portion and the distance of the center of gravity of the first vessel from the at least one axis to a second moment which is a product of gravity force acting upon the supporting means of the second portion and the distance of the center of gravity of the second vessel from the at least one axis varies to induce a movement of the carrier toward the further position as a result of the flow of flowable substance from the first vessel into the second vessel.

The carrier can include a balance beam which is tiltable, swingable or similarly movable about at least one axis and has a first arm including the first portion with the respective supporting means and a second arm including the second portion with the respective supporting means. The first arm is or can be shorter than the second arm.

The balance beam can include a cradle, and such cradle can include at least one rocker which is rockable between the starting position and the further position. The rocker can include a first arcuate section which constitutes the first portion of the carrier and a second arcuate section which constitutes the second portion of the carrier. In accordance with a presently preferred embodiment, the radius of curvature of the first section (which can hold the first vessel) is smaller than the radius of curvature of the second section.

The mutual positions of supporting means of the first and second carrier portions can be such that the mouth of one of the vessels (particularly the mouth of the first vessel) extends into the mouth of the other vessel when the first and second vessels are properly held by the respective supporting means.

The supporting means of one of the two carrier portions can be mounted for movement between a plurality of different levels. Such apparatus can further comprise means for releasably locking the respective supporting means at a selected level. The just discussed supporting means preferably forms part of the first carrier portion (for the first vessel).

The apparatus can further comprise means (e.g., one or more candles) for illuminating the first vessel while the first vessel is held by the respective supporting means. Such illuminating means can be mounted on the first portion of the carrier.

Still further, the apparatus can employ a spout having a substance-receiving first portion insertable into the mouth of the first vessel and a substance-discharging second portion which is receivable in the mouth of the second vessel while the first and second vessels are held by the respective supporting means. The spout can be composed of an outer tube for the flowable substance, and an inner tube having an air intake end above the upper level of flowable substance in the first vessel and an air-discharge end in the second vessel or in the atmosphere. The spout can further comprise a plug which surrounds the substance-receiving first portion and is sealingly insertable into the mouth of the first vessel.

The carrier can include a pendulum including a rigid or flexible first arm with an upper part pivotable about a predetermined axis and a lower part, a second arm extending from the lower part and including the first portion of the carrier, and a third arm extending from the lower part opposite the second arm and including the second portion of the carrier.

It is also possible to employ a carrier which includes a balance beam having a first arm including the first portion of the carrier, a second arm including the second portion of the carrier, and an elongated spring (e.g., a leaf spring) having a lower portion swingable about a fixed axis and an upper portion affixed to the balance beam between the first and second arms.

The novel features which are considered as characteristic of the invention are set forth in particular in the appended claims. The improved decanting apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
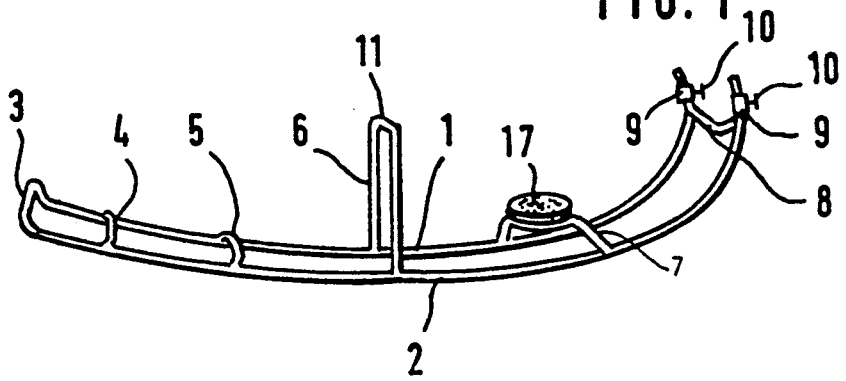
FIG. 1 is a schematic perspective view of a decanting apparatus which embodies one form of the invention.
Figure 2:
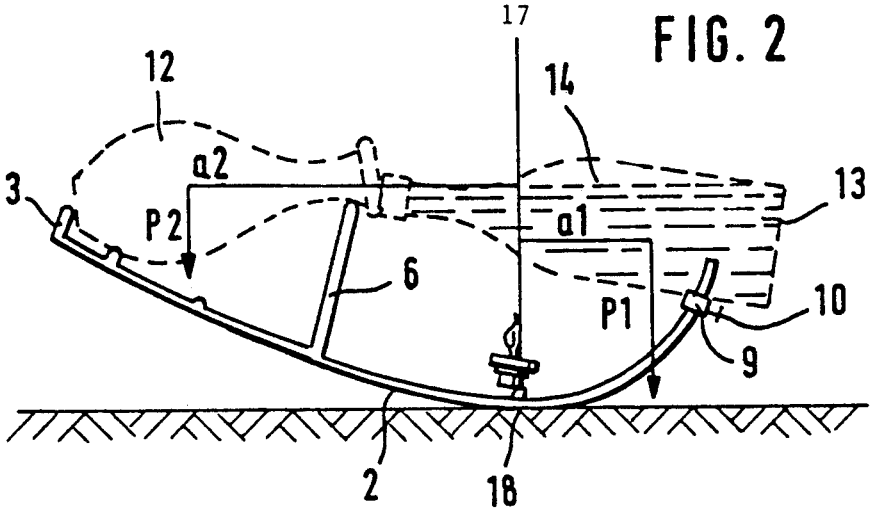
FIG. 2 is a side elevational view of the apparatus which is shown in FIG. 1, the carrier for the vessels being shown in its starting position preparatory to or during the initial stage of decanting of a flowable substance from one of the vessels into the other vessel.
Figure 3:
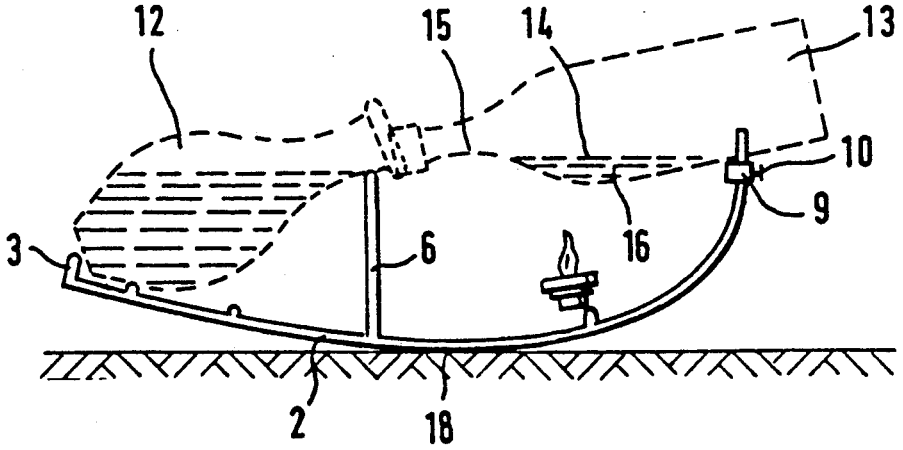
FIG. 3 is another side elevational view of the apparatus but showing the carrier in a further position in which the decanting operation is completed or nearly completed while the sediment remains in the one vessel.

FIGS. 1, 2, 3 and 6 show a first decanting apparatus with a carrier in the form of a cradle assembled of two spaced-apart rockers 1, 2 and several transversely extending bridges or braces 3, 4, 5, 6, 7 and 8 between the rockers. The brace 8 is provided with mobile coupling elements 9 which are slidable along the adjacent portions of the rockers 2, 3 and can be releasably locked to the rockers in selected positions at different levels by suitable (e.g., threaded) fasteners 10. The carrier including the rockers 1, 2 and the braces 3 to 8 can be rocked between a starting position which is shown in FIG. 2, through a practically infinite number of intermediate positions, and to a further position which is shown in FIG. 3. The brace 8 can be said to form part of or to constitute a means for- supporting a first vessel 13 (e.g., a bottle of red wine) in a substantially horizontal position when the carrier including the rockers 1 and 2 assumes the starting position of FIG. 2. At such time, the open mouth of the vessel 13 is in register with and preferably extends into the mouth of an empty second vessel 12 (e.g., a carafe) which is carried by a supporting means including the braces 3, 4 and the substantially stirrup-shaped brace 6 having a suitably configurated upper portion or crossbar 11 which serves to directly support the neck of the second vessel 12 adjacent the mouth. The reference character 18 denotes in FIG. 2 a horizontal axis about which the rockers 1, 2 can rock from the starting position in response to flow of a flowable substance (such as red wine) from the mouth of the vessel 13 into and inwardly beyond the mouth of the vessel 12. This causes the axis 18 to migrate from the position of FIG. 2 toward and ultimately all the way to the position of FIG. 3.

As can be seen in FIGS. 1 to 3, the right-hand portion or arm (to the right of the axis 18) of the carrier including the rockers 1, 2 and the braces 3 to 8 is shorter than the left-hand portion or arm of this carrier. Moreover, the radii of curvature of the right-hand portions of the rockers 1, 2 are smaller than the radii of curvature of the left-hand portions of these rockers.

The brace or bridge 5 serves the purpose of stiffening the carrier, i.e., this brace need not form part of the supporting means for the second vessel 12. The brace 7 serves as a support for an illuminating device 17 (such as a candle) which can be lit when the decanting apparatus is put to use in order to permit more convenient observation of sediment in the residue 16 (FIG. 3) of flowable substance which remains in the vessel 13 when the decanting operation is at least substantially completed.

As the axis 18 (i.e., the line including the points of contact between the convex undersides of the rockers 1, 2 and the upper side of a table, counter, bar or another support for the decanting apparatus) migrates from the locus of FIG. 2 toward the locus of FIG. 3, the quantity of flowable substance in the vessel 13 gradually decreases with simultaneous increase of the quantity of flowable substance in the vessel 12. The force of gravity acting upon the supporting means (brace 8) for the vessel 13 is denoted by the reference character $P_1$, and the force of gravity acting upon the supporting means (braces 3, 4, 6) for the vessel 12 is denoted by the character $P_2$. The ratio of a first moment including the product of gravity force $P_1$ and the distance $a_1$ of the center of gravity of the vessel 13 from the vertical plane including the axis 18 to a second moment including the product of gravity force $P_2$ and the distance $a_2$ of the center of gravity of the vessel 2 from the vertical plane including the axis 18 varies in response to rocking of the carrier in a counterclockwise direction (from the starting position of FIG. 2) whereby such rocking continues until the decanting operation is completed. When the decanting operation begins, the upper level 14 of the supply of flowable substance in the vessel 13 is at least slightly above the lowermost point of the path which is defined by the mouth of the vessel 12 so that the flowable material is free to flow into the vessel 12 under the action of gravity. This causes a change of the aforediscussed ratio of moments with automatic progress of the decanting operation so that the vessel 13 ultimately contains only a relatively small residue 16 which is confined in the main portion adjacent the neck 15 of the vessel 13. The sediment (if any) is contained in the residue 16.

If the person in charge notes that the residue 16 contains little or no sediment, the cradle-like carrier can be pivoted by hand beyond the (further) position of FIG. 3 so as to cause at least a certain percentage of residue 16 to enter the second vessel 12.

The brace 8 has an arcuate shape and the curvature of its concave upper side can conform to the curvature of the adjacent portion of the vessel 13, especially if the decanting apparatus is used for decanting of identical vessels 13 so that it pays to shape the brace 8 for the express purpose of having its concave upper side conform to the curvature of the adjacent portion of a vessel 13.

The brace 3 is arched upwardly and can be said to constitute a stop which abuts the bottom wall of a properly positioned vessel 12. At such time, a convex portion of the vessel 12 abuts the preferably concave upper side of the brace 4, and the upper portion 11 of the brace 6 can be provided with a socket to receive the adjacent portion of the neck of the bottle 12. Thus, the bottle 12 can abut its supporting means at three different locations (braces 3, 4 and 6), and the vessel 13 can merely abut a one-piece supporting means 8 because its mouth is properly oriented by the mouth of the vessel 12. However, it is within the purview of the invention to provide the carrier of FIGS. 1 to 3 and 6 with a composite supporting means for the vessel 13 (e.g., by providing an additional brace adjacent the brace 6 to support the neck 15 of the vessel 13) and/or to make at least one of the braces 3, 4, 6 adjustable (longitudinally and/or transversely of the rockers 1, 2) in order to enhance the stability and reliability of the supporting means for the vessel 12. Still further, it is possible to design the upper portion 11 of the brace 6 in such a way that it can properly support the mouth of the vessel 12 and/or the mouth of the vessel 13.

The placing of the vessels 12, 13 onto the respective supporting means is preferably as follows: The vessel 12 is placed onto the braces 4, 6 and into abutment with the brace 3 in a first step. The operator thereupon removes the cork from the filled vessel 13 and places the maximum-diameter portion of this vessel onto -.the brace 8. The vessel 13 is thereupon gradually tilted toward the position of FIG. 2 in which the upper level 14 of the confined flowable substance can begin to flow into the vessel 12. The "weighing device" including the carrier of FIGS. 1 to 3 is or can be properly tared or balanced (i.e., the two portions or arms of the carrier can be maintained in a state of equilibrium when the vessels 12, 13 are properly mounted on the respective supporting means 3, 4, 6 and 8. If the state of equilibrium is not entirely satisfactory, the person in charge loosens the fasteners 10 and moves the brace 8 to a different level until the carrier is properly balanced and the decanting operation can begin as soon as the brace 8 is releasably locked at the newly selected level.

The carrier of FIGS. 1 to 3 is less sensitive to stresses to the right than to the left of the axis 18. This is due to the aforediscussed selection of the lengths of the two portions of the carrier and of the radii of curvature of corresponding sections of the rockers 1 and 2.

If the decanting apparatus is to be used for decanting of flowable substances (e.g., red wine) from a series of identical vessels 13 into one and the same vessel 12 or into any one of a plurality of identical vessels, the aforediscussed accurate balancing or taring operation (by changing the level of the brace 8) must be carried out only once; the brace 8 thereupon remains in the selected position (at a selected level) until and unless the apparatus is to be set up for decanting flowable substances from different vessels 13 and/or into different vessels 12.

The aforementioned moments ($P_1 \times a_1$ and $P_2 \times a_2$) are identical or practically identical when the decanting operation is to begin, i.e., when the carrier assumes the starting position of FIG. 2. However, as the flowable substance begins to gather in the vessel 12, the ratio of the two moments changes and, by seeking a state of equilibrium, the cradle-like carrier is caused to rock in a counterclockwise direction through the aforementioned intermediate positions toward the further position of FIG. 3 with resulting gradual transfer of the flowable contents of the vessel 13 into the vessel 12. The moment $P_2 \times a_2$ increases as a result of transfer of the contents of the vessel 13 into the vessel 12 even though the axis 18 travels to the left, i.e., even though the distance $a_1$ increases while the distance $a_2$ decreases. The bottom wall of the vessel 12 descends at a rate which is proportional to the rate of flow of flowable substance from the vessel 13. Migration of the axis 18 from the position of FIG. 2 toward the position of FIG. 3 ensures that the rocking or tilting of the carrier including the rockers 1, 2 and the braces 3 to 8 is gradual so as to avoid agitation of sediment (if any) in the vessel 13 in the course of the decanting operation. In other words, the carrier is not likely to rock back and forth about the axis 18 so that the flowable substance which enters the vessel 12 is at least substantially devoid of sediment.

The configuration of the maximum-diameter portion of the vessel 13 and of the shoulder at the transition between the maximum-diameter portion and the neck 15 of this vessel can be readily selected in such a way that the quantity of flowable substance which forms the residue 16 is relatively small (to avoid wasting of expensive red wine, port or another sediment-containing beverage) but suffices to ensure that the sediment remains in the practically or nearly emptied vessel 13. As mentioned above, the quantity of flowable substance which forms the residue 16 can be reduced by manually tilting the carrier beyond the further position of FIG. 3, i.e., by raising the level of the bottom end wall of the vessel 13 to a desired extent. Lighting of the candle 17 is or can be of assistance if the decanting apparatus is used in a dimly lit area because even a relatively small flame enables the person in charge to observe the quantity of flowable substance which constitutes the residue 16 prior to deciding whether or not the quantity of this residue is to be reduced, e.g., to zero or close to zero if the residue is devoid of any sediment.

Figure 6:
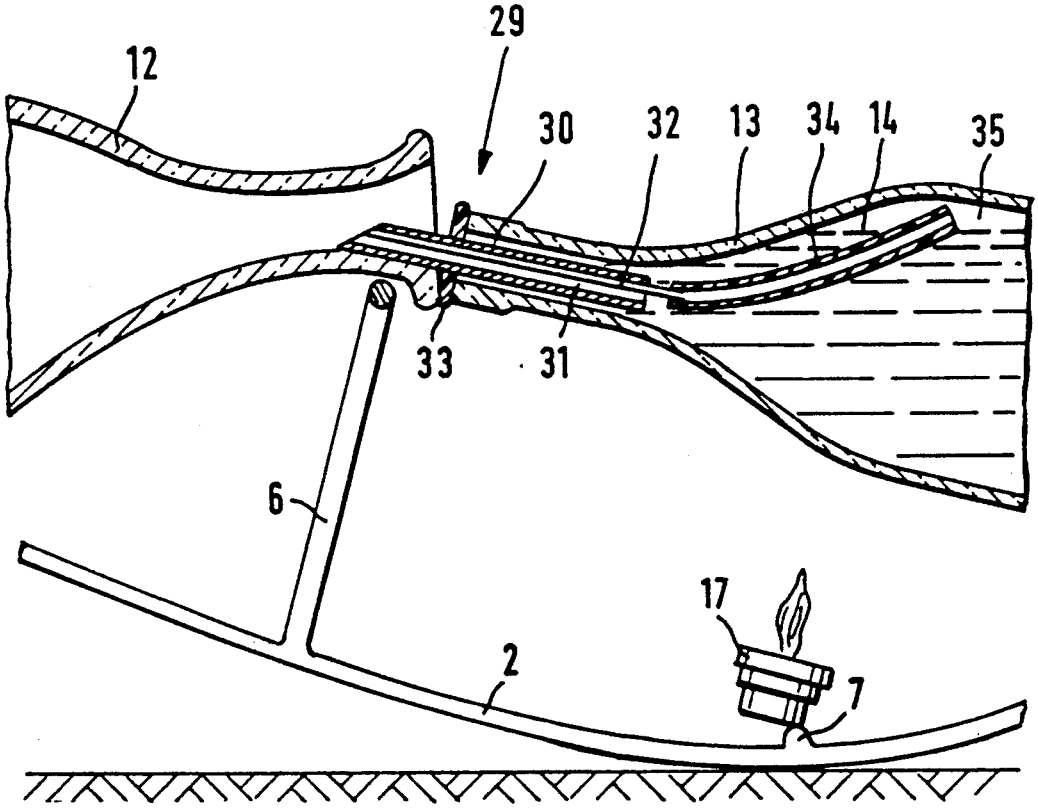
FIG. 6 is an enlarged fragmentary view of a detail in the apparatus of FIGS. 1 to 3 and further showing a spout which is used to confine the flow of flowable substance from the one vessel into the other vessel.

FIG. 6 shows that dripping of flowable substance at the mouth of the vessel 13 can be prevented in a simple and efficient way by employing a spout 29 having an outer tube 31 with a substance-receiving portion in the neck of the vessel 13 and a substance-discharging portion in the neck of the vessel 12. The illustrated spout 29 further comprises a smaller-diameter inner tube 32 having a pivotable extension 34 with an open air-discharging end in the air-filled space 35 above the upper level 14 of flowable substance in the vessel 13, and an air-receiving open end in the interior of the vessel 12 or in the atmosphere. The spout 29 further comprises a preferably conical plug 30 which surrounds the substance-receiving portion of the tube 31 in the vessel 13 and is frictionally held in the mouth of this vessel. The plug 30 (e.g., a piece of cork) is adjacent a disc-shaped closure 33 which abuts the end face of the mouth of the vessel 13.

The spout 29 ensures decanting of the flowable substance at a predictable rate and reduces the likelihood of splashing during decanting. The likelihood of splashing is further reduced by the inner tube 32 and its extension 34; such inner tube admits into the space 35 atmospheric air at a rate which is proportional to the rate of flow of flowable substance via outer tube 31, i.e., the tube 32 prevents penetration of air bubbles into the vessel 13 in the course of a decanting operation, and this greatly reduces the likelihood of splashing which is particularly undesirable if the flowable substance is expensive and/or if the composition of the flowable substance is such that it is likely to damage or destroy the garment or suit of the person in charge and/or a table cloth or the like.

The inner diameter of the inner tube 32 can be a small or minute fraction of the inner diameter of the outer tube 31. The extension 34 can constitute a piece of flexible hose; however, it is equally possible to employ a one-piece inner tube 32 which extends all the way from the space 35 into the atmosphere or into the vessel 12 when the spout 29 is properly installed in the mouth of the vessel 13. An advantage of a readily flexible and lightweight extension 34 is that its open end tends to rise in the vessel 13 until it reaches and communicates with the space 35, even when the vessel 13 is practically filled with a liquid. The closure 33 can be fixedly connected to or made integral with the outer tube 31 and/or with the plug 30.

It has been found that the improved spout 29 prevents pulsating outflow of flowable substance from the vessel 13 in the course of a decanting operation. The absence of bubbles of air during decanting not only reduces the likelihood of splashing of flowable material in and during flow into the vessel 12 but also reduces the likelihood of agitation of sediment (if any) in the vessel 13.

Figure 4:
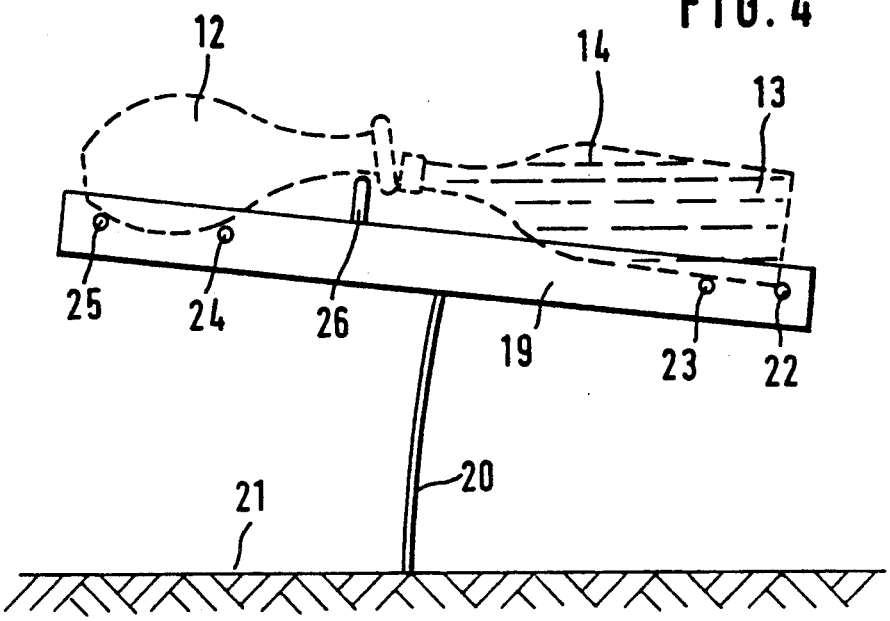
FIG. 4 is a side elevational view of a second decanting apparatus with the carrier shown in the starting position.

FIG. 4 shows a modified decanting apparatus wherein the carrier includes an elongated straight balance beam 19 which can be assembled of two or more elongated parallel components with transversely extending braces 22, 23, 24, 25 and 26. The braces 24, 25, 26 of the left-hand portion or arm of the beam 19 constitute a supporting means for the vessel 12 (e.g., a carafe for red wine), and the braces 22, 23 of the right-hand portion or arm of the beam 19 constitute a supporting means for the vessel 13 (e.g., a bottle of red wine). The brace 26 is or can be analogous to the brace 6 of the decanting apparatus of FIGS. 1–3 and 6 and serves to support the neck of the vessel 12 adjacent the mouth.

The median portion of the beam 19 is affixed to the upper end portion of an elongated upright leaf spring 20 the lower end portion of which is anchored in a suitable support 21 (e.g., a table, a counter or a bar). The flexibility of the spring 20 is selected in such a way that it permits the beam 19 to change its inclination (by pivoting in a counterclockwise direction about a horizontal axis at the lower end of the spring 20) while the flowable substance flows from the vessel 13 into the vessel 12. The leaf spring 20 can have an elongated rectangular cross-sectional outline.

At least one of the components of supporting means for the vessels 12 and 13 of FIG. 4 can be adjustably secured to the balance beam 19 so as to permit the establishment of a desirable equilibrium between the weights which are carried by the two arms of the balance beam in the starting position of FIG. 4. As the flowable substance begins to flow from the vessel 13 into the vessel 12, the state of equilibrium is destroyed and the beam 19 is caused to change its inclination by turning in a counterclockwise direction with resulting continuous and gradual decanting of flowable substance from the vessel 13. The inclination of the leaf spring 20 changes during decanting, i.e., this spring moves toward, into and thereupon beyond a vertical plane as the combined weight of the vessel 12 and its contents increases in the course of the decanting operation. The upper level 14 of the supply of flowable substance in the vessel 13 remains at least slightly above the lowermost portion of the path which is defined by the mouth of the vessel 12 during each stage of the decanting operation. The residue or remnant 16 (not shown in FIG. 4) remains in the lowermost portion of the vessel 13 when the beam 19 reaches a position corresponding to the position of the carrier or cradle in FIG. 3.

Figure 5:
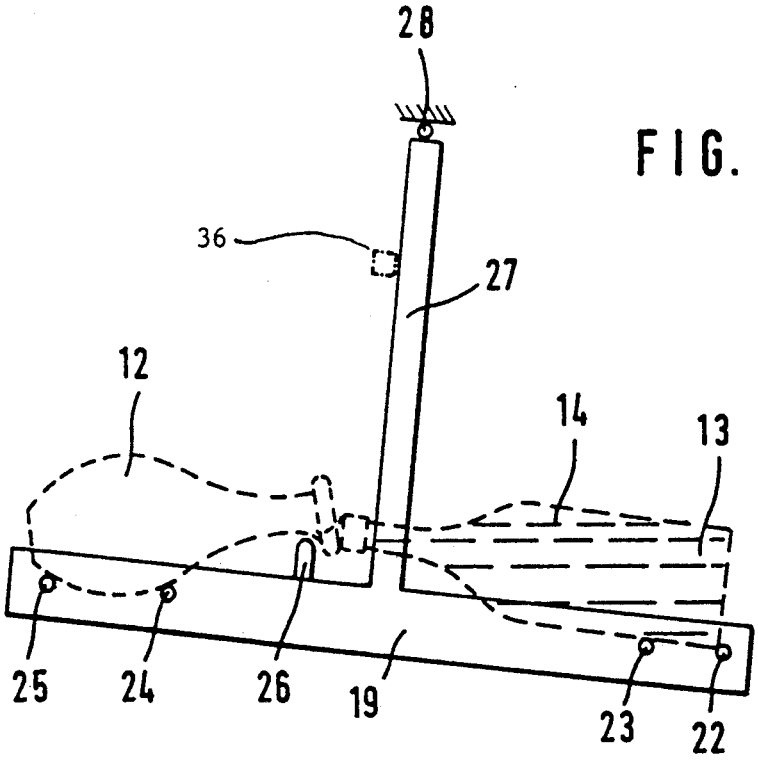
FIG. 5 is a side elevational view of a third apparatus with the carrier shown in the starting position.

FIG. 5 shows a third decanting apparatus wherein the beam 19 and the supporting means 24–26 and 22–23 for the vessels 12, 13 are or can be identical with the similarly referenced parts of the decanting apparatus of FIG. 4. The difference between the decanting apparatus of FIGS. 4 and 5 is that the median portion of the beam 19 in FIG. 5 is rigid with the lower portion of an elongated arm 27 the upper portion of which is fulcrumed at 28 so that the carrier including the arm 27 and the two portions or arms of the beam 19 is swingable about a horizontal axis. A preferably adjustable stop 36 (indicated by broken lines) can be provided to arrest the arm 27 in the angular position of FIG. 5 which corresponds to the starting position of the carrier including the arm 27 and the twin-armed beam 19. As the decanting proceeds, the combined weight of the vessel 12 and its contents increases so that the arm 27 moves away from the stop 36 at a desired rate to ensure that the carrier can assume the aforediscussed further or end position in which the transfer of flowable substance from the vessel 13 into the vessel 12 is at least substantially completed. The operator can reduce the quantity of residue if an inspection of the substantially emptied vessel 13 reveals that the residue is devoid of sediment or that the quantity of flowable substance which forms the residue is excessive.

The arm 27 can constitute a U-shaped yoke which connects two elongated parallel sections of the beam 19 with each other and serves as a means for suspending the beam on the fulcrum 28 for operation not unlike a pendulum type weighing device. The braces 22, 23 can be said to constitute a pan or supporting means for the vessel 13, and the braces 24–26 can be said to constitute a pan or supporting means for the vessel 12.

It is preferred to make the right-hand portion or arm of the beam 19 of FIG. 4 or 5 at least slightly shorter than the left-hand arm. This facilitates the balancing of the carrier including the beam 19 preparatory to start of a decanting operation. Thus, the lever arm which is to carry the vessel 13 should be or can be somewhat shorter than the left-hand lever arm.

The position of the stop 36 in FIG. 5 is selected in such a way that the upper level 14 of flowable substance in the vessel 13 (at the start of decanting is at least slightly above the lowermost point of the path which is defined by the mouth of the vessel 12. This ensures that the decanting can begin and that such decanting proceeds until the vessel 13 contains nothing more but the residue 16. A similar stop can be used (if necessary) in or with the decanting apparatus of FIG. 4 and/or in or with the decanting apparatus of FIGS. 1–3 and 6.

It will be readily appreciated that the improved apparatus can be used for decanting of flowable substances from one bottle into another (clean and empty) bottle, from a jug into a bottle or carafe or from any other suitable first vessel into any other suitable second vessel.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for gradually decanting a flowable substance from the mouth of a first vessel into the mouth of a second vessel, particularly for ;; decanting red wine or port from a bottle into a carafe, comprising means for providing an alternative to decanting by hand, including a mobile carrier having a first portion including means for supporting the first vessel and a second portion including means for supporting the second vessel so that the mouth of the second vessel registers with the mouth of the first vessel, said carrier being movable by the flowable substance (a) from a starting position in which the upper level of flowable substance in the first vessel is sufficiently high to permit gravity-induced flow of flowable substance into the second vessel, (b) through a plurality of intermediate positions, and (c) to a further position in which at least the major part of the flowable substance is confined in the second vessel.

2. The apparatus of claim 1 for gradually decanting a flowable substance from the mouth of a first vessel having a first center of gravity into the mouth of a second vessel having a second center of gravity, wherein said carrier is movable about at least one axis and the mouth of the second vessel in the starting position of said carrier is located at least in part beneath the upper level of flowable substance in the first vessel, the ratio of a first moment including the product of gravity force acting upon the supporting means of said first portion and the distance of said first center of gravity from said at least one axis to a second moment which is a product of gravity force acting upon the supporting means of said second portion and the distance of said second center of gravity from said at least one axis varying to thus induce a movement of said carrier toward said further position as a result of the flow of flowable substance from the first vessel into the second vessel.

3. The apparatus of claim 1, wherein said carrier includes a balance beam which is tiltable about at least one axis and has a first arm including said first portion and a second arm including said second portion.

4. The apparatus of claim 3, wherein said first arm is shorter than said second arm.

5. The apparatus of claim 3, wherein said balance beam includes a cradle.

6. The apparatus of claim 5, wherein said cradle includes at least one rocker which is rockable between said starting position and said further position.

7. The apparatus of claim 6, wherein said rocker has a first arcuate section constituting said first portion and a second arcuate section constituting said second portion, said first section having a first radius of curvature and said second section having a larger second radius of curvature.

8. The apparatus of claim 7, wherein the one vessel is the first vessel.

9. The apparatus of claim 1, wherein the mutual positions of supporting means of said first and second portions are such that the mouth of one of the vessels extends into the mouth of the other vessel when the first and second vessels are held by the respective supporting means.

10. The apparatus of claim 1, wherein the supporting means of one of said portions is movable between a plurality of different levels.

11. The apparatus of claim 10, wherein said one portion includes means for releasably locking the respective supporting means at a selected level.

12. The apparatus of claim 11, wherein said one portion is said first portion.

13. The apparatus of claim 1, further comprising means for illuminating the first vessel while the first vessel is held by the respective supporting means.

14. The apparatus of claim 13, wherein said illuminating means is mounted on said first portion.

15. The apparatus of claim 14, wherein said illuminating means includes a candle.

16. The apparatus of claim 1, further comprising a spout having a substance-receiving first portion insertable into the mouth of the first vessel and a substance-discharging second portion receivable in the mouth of the second vessel.

17. The apparatus of claim 16, wherein said spout includes an outer tube for the flowable substance and an inner tube having an air intake end above the upper level of flowable substance in the first vessel and an air discharge end in the second vessel.

18. The apparatus of claim 16, wherein said spout further comprises a plug surrounding the substance-receiving first portion and being sealingly insertable into the mouth of the first vessel.

19. The apparatus of claim 1, wherein said carrier includes a pendulum having a first arm with an upper part pivotable about a predetermined axis and a lower part, a second arm extending from the lower part and including said first portion, and a third arm extending from the lower part opposite said second arm and including said second portion.

20. The apparatus of claim 1, wherein said carrier includes a balance beam having a first arm including said first portion, a second arm including said second portion, and an elongated spring having a lower portion swingable about a fixed axis and an upper portion affixed to said beam between said arms.

* * * * *